United States Patent [19]

Takeshima et al.

[11] 4,429,438

[45] Feb. 7, 1984

[54] SLIDE FASTENER STRINGER

[75] Inventors: Kiyoshi Takeshima, Namerikawa; Yoshinori Masuda, Kurobe, both of Japan

[73] Assignee: Yoshida Kogyo K. K., Tokyo, Japan

[21] Appl. No.: 287,131

[22] Filed: Jul. 27, 1981

[30] Foreign Application Priority Data

Aug. 1, 1980 [JP] Japan ..... 55-106615

[51] Int. Cl.[3] ..... A44B 19/00

[52] U.S. Cl. ..... 24/401

[58] Field of Search ..... 24/205.16 R, 205.13 D

[56] References Cited

U.S. PATENT DOCUMENTS

| | | | |
|---|---|---|---|
| 3,328,857 | 7/1967 | Burbank | 24/205.13 |
| 3,885,273 | 5/1975 | Heimberger | 24/205.13 D |
| 4,186,467 | 2/1980 | Lawrence | 24/205.16 R |
| 4,290,175 | 9/1981 | Moertel | 24/205.13 D |
| 4,291,440 | 9/1981 | Yoshida | 24/205.16 R |

FOREIGN PATENT DOCUMENTS

| | | | |
|---|---|---|---|
| 2741579 | 3/1978 | Fed. Rep. of Germany | 24/205.13 D |

*Primary Examiner*—Gene Mancene
*Assistant Examiner*—Wenceslao J. Contreras
*Attorney, Agent, or Firm*—Hill, Van Santen, Steadman & Simpson

[57] ABSTRACT

A slide fastener stringer comprising a woven coupling element having a plurality of first and second connecting portions interconnecting a plurality of laterally spaced scoops of the element. Each of the first connecting portions extends between adjacent two of first legs of the scoops which is disposed at one side of a tape while each of the second connecting portions extends between adjacent two of the second legs of scoops disposed at the other side of the tape, the first connecting portions being staggered relative to the second connecting portions.

5 Claims, 11 Drawing Figures

SLIDE FASTENER STRINGER

BACKGROUND OF THE INVENTION

1. Field of the Invention

The present invention relates to a slide fastener and more particularly to a fastener stringer having a row of successively interconnected coupling element scoops woven into a longitudinal edge of a stringer tape during the weaving thereof by a needle loom.

2. Prior Art

Slide fastener stringers of the type described are generally divided into two categories, one comprising a coiled plastic monofilament woven into a longitudinal edge of a woven stringer tape as the tape is woven, and the other comprising a preformed coupling element assembly which is woven into a longitudinal tape edge during the course of weaving of a stringer tape, the coupling element assembly consisting of a row of discrete coupling elements interconnected by embedded connecting threads.

The first-mentioned stringers have been proven less useful on articles that are expected to meet severe pulling tension.

The second known stringer employ connecting threads having a smooth surface that fails to provide a required degree of bonding strength so that interconnected coupling elements are liable to be accidentally displaced from a proper positional relationship with each other. Another problem with the stringer is that the connecting threads, which are made rigid enough for secure attachment of the coupling elements to a stringer tape, are not stretchable sufficiently to allow for smooth engagement and disengagement between opposed rows of coupling elements.

U.S. Pat. No. 3,328,857, issued July 4, 1967 to Burbank discloses another and somewhat more successful stringer comprising a series of spaced individual coupling elements connected by a pair of cords, one along each side of the stringer and having secured thereto the legs of the coupling element. Alternate sections of each cord in the spaces between coupling elements are covered with plastic, with those sections on one side of fastener being staggered with respect to the covered sections on the cord on the other side of the fastener, to thereby seek to provide the stringer with a desired degree of flexibility. However, the cord covered with plastic serves to reinforce the plastic sections and makes the coupling element row less flexible.

SUMMARY OF THE INVENTION

According to the invention, a slide fastener stringer comprises a woven stringer tape formed with warp threads and a weft thread, and an elongate coupling element woven into a longitudinal edge of the tape, the element having a plurality of first and second connecting portions interconnecting a plurality of laterally spaced scoops of the element. Each of the first connecting portions extends between adjacent two of first legs of the scoops which is disposed at one side of the tape while each of the second connecting portions extends between adjacent two of second legs of the scoops disposed at the other side of the tape, the first connecting portions being staggered relative to the second connecting portions. Each of the legs is reduced in width progressively in a direction from a coupling head of one of scoops to the distal end thereof.

It is an object of the invention to provide a slide fastener stringer having a woven coupling element that is fastened securely in place.

Another object of the invention is to provide a slide fastener stringer with desired flexibility which enables smooth threading of a slider.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION OF THE PREFERRED EMBODIMENTS

Figure 1:
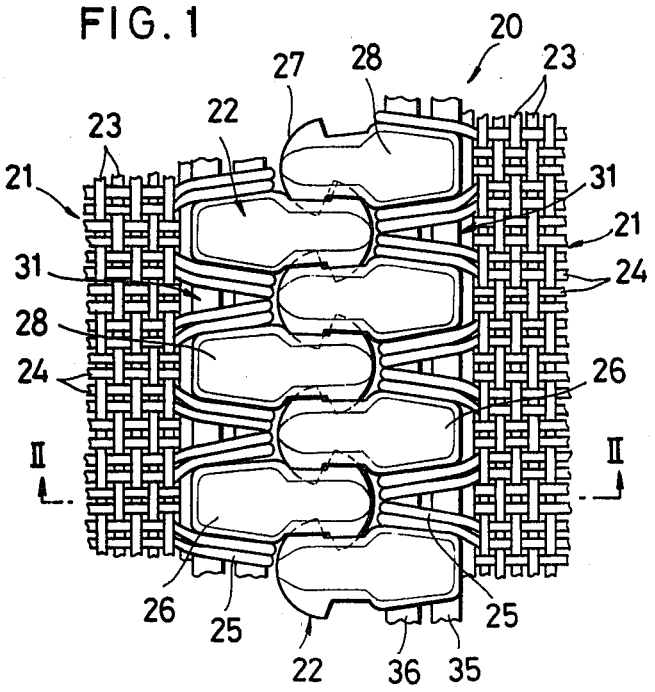
FIG. 1 is a fragmental plan view of a slide fastener having a pair of mating stringers constructed in accordance with the present invention.
Figure 2:
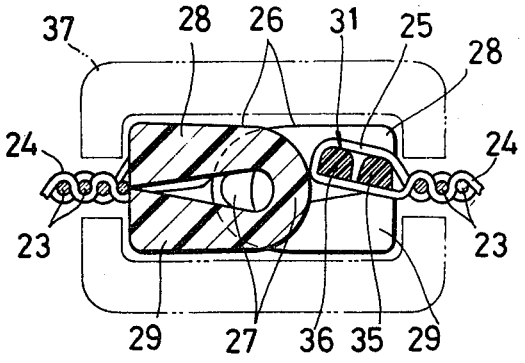
FIG. 2 is a cross-sectional view taken along line II—II of FIG. 1.
Figure 3:
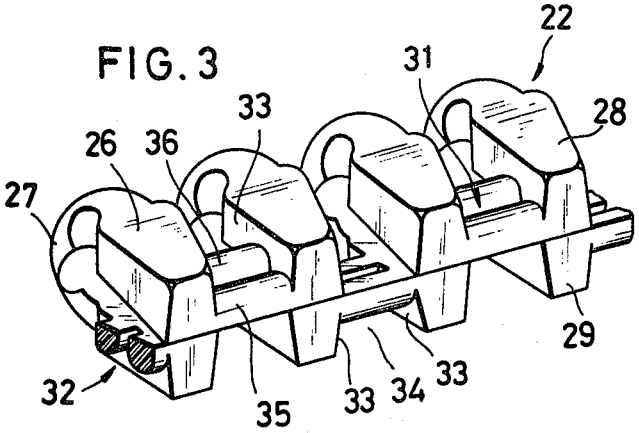
FIG. 3 is a fragmentary perspective view of an elongate coupling element of the invention.

The principles of the present invention are particularly useful when embodied in a slide fastener stringer such as schematically shown in FIGS. 1 and 2, generally indicated by the numeral 20.

The fastener stringer 20 essentially comprises a woven stringer tape 21 and an elongate coupling element 22 mounted on and along a longitudinal edge of the tape 21. The stringer tape 21 is composed of a plurality of warp threads 23 and a single weft thread 24 interwoven with the warp threads 23, the weft thread 24 having a plurality of loops 25 disposed along the longitudinal edge of the tape 21.

As best illustrated in FIGS. 3 to 6, the elongate coupling element 22 of synthetic resin has a plurality of scoops 26 extending weftwise or transversely of the tape 21 and spaced laterally from each other in the longitudinal direction of the tape 21. Each scoop 26 has a substantially U-shaped cross section and includes a coupling head 27 and a pair of first and second legs or upper and lower legs 28,29 extending from the coupling head 27 in a common direction. The coupling head 27 is dimensioned to releasably couple with a corresponding head of a scoop 26 on a mating stringer to open and close the fastener in the well known manner. The first and second legs 28 and 29 are spaced apart in substantially superimposed relation to each other and contacting together at respective distal ends 30,30, each leg being tapered off as viewed from the plane or reduced in width progressively in a direction from the coupling head to the distal end.

The coupling element 22 further has a plurality of first connecting portions 31 and a plurality of second connecting portions 32, the first and second connecting portions 31,32 being structurally identical with one another and extending transversely of the scoops 26 in longitudinal alignment with each other as viewed from the general plane of the stringer 20. Each of the first connecting portions 31 extends between adjacent two of the first or upper legs 28 while each of the second connecting portions 32 extends between adjacent two of the second or lower legs 29, the first connecting portions 31 being staggered with respect to the second connecting portions 32.

Figure 4:
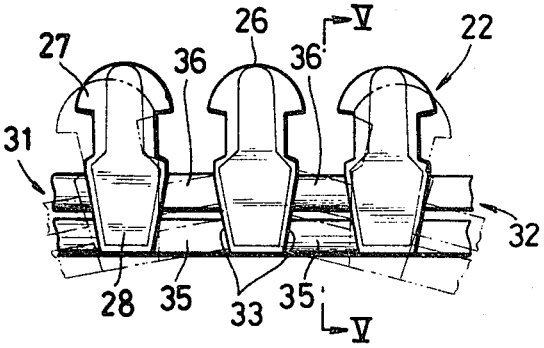
FIG. 4 is a fragmentary plan view of the elongate coupling element.

As shown in FIGS. 2, 3, 5 and 6, the connecting portions 31,32 each have a thickness smaller than the thickness of one of the legs 28,29 to define together with respective sidewalls 33 of adjacent two of the legs 28 or 29 a recess 34 for receiving therein the loops 25 of the weft thread 24 when the coupling element 22 is woven into the longitudinal edge of the stringer tape 21. As shown in FIG. 4, each connecting portion 31,32 is trapezoidal in contour and comprises pair of laterally spaced ribs 35,36 extending parallel to one another, each rib 35,36 having a substantially semi-circular cross section. One of the ribs 35 which is located remotely from the coupling head 27 is longer than the other 36 and is more susceptible of collapsing or bending than the shorter rib 36 when the stringer 20 is bent transversely in one direction. As illustrated by phantom lines in FIG. 4, the connecting portions 31,32 thus constructed allow the coupling element 22 to bent arcuately away from the coupling element 22 of a mating stringer 20 (FIGS. 1 and 2) in conformity with the Y-shaped guide channel of a slider 37 (shown by phantom lines in FIG. 2) when the stringers 20,20 are engaged and disengaged by the slider 37 to open and close the fastener, resulting in smooth threading of the coupling elements 22 into and out of the slider guide channel.

Figure 5:
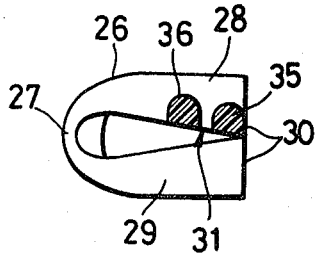
FIG. 5 is a cross-sectional view taken along line V—V of FIG. 4.
Figure 6:
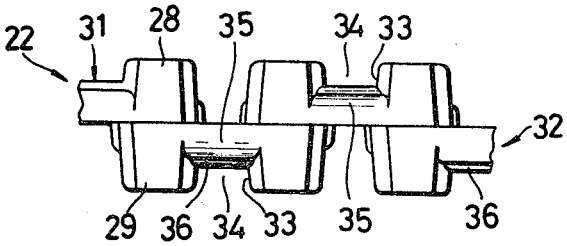
FIG. 6 is a front elevational view of the coupling element shown in FIG. 4.
Figure 7:
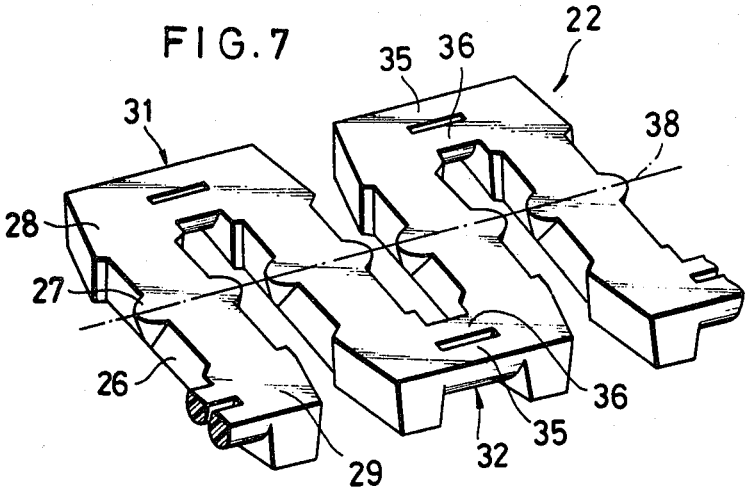
FIG. 7 is a fragmentary perspective view of the coupling element as it is molded before being bent into a U shape.

The coupling element 22 of synthetic resin is continuously produced on an injection molding machine (not shown) and prior to being bent into a U shaped cross-section ready for attachment to the stringer tape 21, has a zigzag or meandering structure as shown in FIG. 7. The coupling element 22 includes a series of the laterally spaced scoops 26 each having the coupling head 27 and the pair of first and second legs 28,29 extending from the coupling head in opposite directions. The first connecting portions 31 extend between alternate pairs of the first legs 28 and the second connecting portions 31 extend between alternate pairs of the second legs 29, the first connecting portions 31 being staggered relative to the second connecting portions 32. The coupling element 22 shown in FIG. 7 is folded on itself about a longitudinal axis 38 until the first and second legs 28,29 are brought into contacting engagement with each other at the respective distal ends 30,30 thereof (FIG. 5). The distal ends 30,30 then may be joined by being integrally fused together or bonded together by an adhesive.

The coupling element 22 thus formed is then mounted on and along the longitudinal edge of the stringer tape 21 as the latter is woven on a needle loom. As shown in FIGS. 1 and 2, the loops 25 of the weft thread 24 extends around the connecting portions 31,32 and are received in the recesses 34 in the coupling element 22 so that they are prevented from frictionally engaging the guide surfaces of the slider 37. If it were not so, the weft thread loops 25 would become frayed or broken away in response to frequent sliding movement of the slider 37. A wedge-like configuration of the legs 28,29 tapered off toward respective distal ends 30,30 is advantageous in that the weft thread loops 25 extend convergently into the stringer tape 21 along the opposite sidewalls 33,33 of the respective legs 28,29 and hence pull the respective scoops 26 toward the stringer tape 21, with the result that the coupling element 22 is stably retained in position on the stringer tape against displacement.

Figure 8:
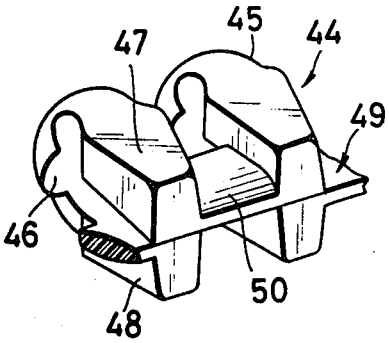
FIG. 8 is a fragmentary perspective view of a modified coupling element of the invention.
Figure 9:
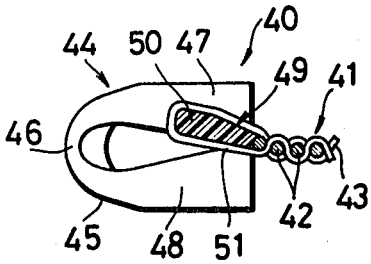
FIG. 9 is a fragmentary cross-sectional view of a slide fastener stringer including the coupling element shown in FIG. 8 as woven into a woven stringer tape.

FIGS. 8 and 9 show another modification in which a fastener stringer 40 likewise comprises a woven stringer tape 41 formed with a plurality of warp threads 42 and a weft thread 43, and a coupling element 44 mounted on a longitudinal edge of the tape 41. The coupling element 44 has a series of scoops 45 (only two of them being shown in FIG. 8) each including a coupling head 46 and a pair of first and second legs 47,48. A connecting portion 49 extending between the first or second legs 47 or 48 comprises a substantially flat rectangular plate 50 around which loops 51 of the weft thread 43 extend for attachment of the coupling element 44 to the tape 41.

Figure 10:
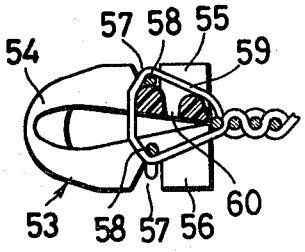
FIGS. 10 and 11 are fragmentary cross-sectional views of different embodiments of slide fastener stringers of the invention.
Figure 11:
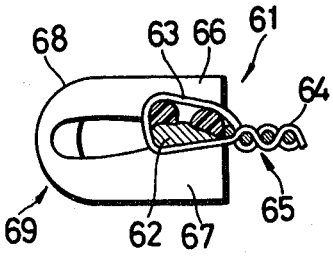

According to still another modification shown in FIG. 10, a scoop 53 has a coupling head 54 and a pair of legs 55,56, each of the legs having a groove 57 extending transversely thereof. A pair of binding warp threads 58 is disposed in the grooves 57 in the legs 55,56, respectively, and both extend through weft thread loops 59 which extend around the respective connecting portions 60. Another modified slide fastener stringer 61 illustrated in FIG. 11 comprises a stuffer warp 62 extending through loops 63 of a weft thread 64 of a stringer tape 65 and disposed between each pair of first and second legs 66,67 of one scoop 68 of a coupling element 69.

Although various minor modifications might be suggested by those versed in the art, it should be understood that we wish to embody within the scope of the patent warranted hereon, all such embodiments as reasonably and properly come within the scope of our contribution to the art.

What is claimed is:

1. A slide fastener stringer comprising:

(a) a continuous coupling element molded of a single material and having a plurality of laterally spaced scoops, each of said scoops including a coupling head and a pair of first and second legs extending from said coupling head in a common direction and contacting each other at respective distal ends thereof, each of said legs having a portion reduced in width progressively in a direction from said coupling head leading to said distal end;

(b) said element further having a series of first connecting portions and a series of second series portions, each of said first connecting portions extending in between two adjacent ones of said first legs, each of said second connecting portions extending between two adjacent ones of said second legs, said first connecting portions being staggered relative to said second connecting portions, each of said connecting portions being fully interrupted only between every second pair of said legs, and (c) a woven stringer tape formed with a plurality of warp threads and a weft thread, said weft thread having a plurality of loops disposed along the longitudinal edge of said stringer tape and extending around alternate ones of said first and second connecting portions, thereby securing said coupling element to said longitudinal tape edge.

2. A slide fastener stringer according to claim 1, said first and second connecting portions each comprising a substantially flat rectangular plate thinner than said legs.

3. A slide fastener stringer according to claim 1, including a pair of binding warp threads extending through said weft loops, each of said scoops having pair of grooves extending transversely of said pair of legs, respectively, said binding warp threads being disposed in said grooves, respectively.

4. A slide fastener stringer according to claim 1, including a stuffer warp extending through said weft loops and disposed between said first and second legs of said scoops.

5. A slide fastener according to claim 1, said first and second connecting portions each comprising a plurality of laterally spaced ribs extending parallel to one another, said ribs each having a substantially semi-circular cross-section.

* * * * *